US009327523B2

(12) United States Patent
Monclus et al.

(10) Patent No.: US 9,327,523 B2
(45) **Date of Patent: *May 3, 2016**

(54) PRINTING DEVICE AND CONTROL METHOD

(71) Applicants: Antonio Monclus, Barcelona (ES); David Claramunt, Sant Esteve Sesrovires (ES); Ezequiel Jordi Rufes, Sant Feliu de Liobregat (ES); Cristina Sabater, La Bisbal d'Emporda (ES); Francisco Javier Rodriguez, Mataro (ES); Francisco Guerrero, Barcelona (ES)

(72) Inventors: Antonio Monclus, Barcelona (ES); David Claramunt, Sant Esteve Sesrovires (ES); Ezequiel Jordi Rufes, Sant Feliu de Liobregat (ES); Cristina Sabater, La Bisbal d'Emporda (ES); Francisco Javier Rodriguez, Mataro (ES); Francisco Guerrero, Barcelona (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/506,890

(22) Filed: Oct. 6, 2014

(65) Prior Publication Data

US 2015/0103113 A1 Apr. 16, 2015

Related U.S. Application Data

(63) Continuation of application No. 12/988,249, filed as application No. PCT/EP2008/054751 on Apr. 18, 2008, now Pat. No. 8,894,303.

(51) Int. Cl.

| | |
|---|---|
| ***B41J 11/44*** | (2006.01) |
| ***B41J 11/00*** | (2006.01) |
| ***B41M 5/00*** | (2006.01) |
| ***B41M 7/00*** | (2006.01) |

(52) U.S. Cl.
CPC ..... *B41J 11/002* (2013.01); *B41M 5/0011* (2013.01); *B41M 7/009* (2013.01)

(58) Field of Classification Search
CPC B41J 2/38; B41J 11/002; G03G 2215/00666; G03G 2215/16666; G03G 2215/1685; B41F 3/52; B41M 5/0011; B41M 7/009
See application file for complete search history.

(56) References Cited

U.S. PATENT DOCUMENTS

| | | | | |
|---|---|---|---|---|
| 3,811,828 | A | 5/1974 | Ohta et al. | |
| 6,049,680 | A * | 4/2000 | Goris et al. | 399/44 |

(Continued)

FOREIGN PATENT DOCUMENTS

| | | |
|---|---|---|
| EP | 1403341 A1 | 3/2004 |
| JP | 2003191468 | 7/2003 |

(Continued)

OTHER PUBLICATIONS

European Patent Office, Communication pursuant to Rules 161(1) and 162 EPC for EP Appl. No. 08736395.8 dated Dec. 14, 2010 (8 pages).

(Continued)

*Primary Examiner* — Matthew G Marini
(74) *Attorney, Agent, or Firm* — Trop Pruner & Hu, PC

(57) ABSTRACT

A controller controls a first heating stage to heat a printing medium to a first temperature in a printing region when printing latex ink on the printing medium, and controls a second heating stage to heat the printing medium to a second temperature greater than the first temperature in a curing region to cure the latex ink on the medium. The controller controls a cooling stage located between the first and second heating stages to cool the printing medium after the printing medium has been heated by the first heating stage and prior to heating of the printing medium by the second heating stage.

17 Claims, 4 Drawing Sheets

(56) References Cited

U.S. PATENT DOCUMENTS

| | | | | |
|---|---|---|---|---|
| 6,103,061 | A * | 8/2000 | Anderson et al. | 162/108 |
| 6,449,458 | B1 | 9/2002 | Lang et al. | |
| 6,996,361 | B2 | 2/2006 | Ichida et al. | |
| 2004/0175208 | A1 * | 9/2004 | Ichida et al. | 399/302 |
| 2005/0244203 | A1 * | 11/2005 | Kamiyama | 399/341 |
| 2007/0024686 | A1 | 2/2007 | Kadomatsu et al. | |
| 2007/0229639 | A1 * | 10/2007 | Yahiro | 347/102 |
| 2008/0043082 | A1 * | 2/2008 | Yahiro | 347/103 |

FOREIGN PATENT DOCUMENTS

| | | |
|---|---|---|
| JP | 2005096373 | 4/2005 |
| JP | 2006264328 | 10/2006 |
| WO | WO-0144326 | 6/2001 |
| WO | WO-2007112337 A1 | 10/2007 |

OTHER PUBLICATIONS

European Patent Office, Communication Under Rule 71(3) EPC for EP Appl. No. 08736395.8 dated Oct. 18, 2011 (28 pages).

European Patent Office, International Search Report and the Written Opinion for PCT/EP2008/054751 dated Feb. 6, 2009 (12 pages).

The International Bureau of WIPO, International Preliminary Report on Patentability for PCT/EP2008/054751 dated Oct. 28, 2010 (7 pages).

* cited by examiner

500

PRINTING DEVICE AND CONTROL METHOD

CROSS-REFERENCE TO RELATED APPLICATIONS

This is a continuation of U.S. application Ser. No. 12/988,249, filed Oct. 15, 2010, which a national stage application under 35 U.S.C. §371 of International Application No. PCT/EP2008/054751, filed Apr. 18, 2008, which applications are hereby incorporated by reference.

TECHNICAL FIELD

The present invention relates to a printing device for printing a latex ink on a printing medium.

The present invention further relates to a method for controlling such a printing device.

BACKGROUND

In the field of printing technology, a need exists for providing inks that allow for the generation of an image on a printing medium that retains a high image quality over a prolonged period of time, e.g. several years. Potentially interesting types of inks are water-based latex inks. An example of an ink comprising a latex binder is for instance given in PCT patent application WO 2007/112337 by the present applicant. The latex binder is added to the ink to bind the ink to the medium after printing.

In order to cure the latex in the ink following printing, the medium carrying the ink must be exposed to an elevated temperature. To this end, WO 2007/112337 proposes the use of any number of heated pick-up rollers, hot air fans or radiation devices.

In European patent application EP 1 403 341 A1, heating is employed during and after printing of a latex comprising ink on a non-absorbing substrate. The heating steps help spreading the ink over the non-absorbing substrate and accelerate the evaporation of the fluids in the ink solution. The heating steps during and after printing may be employed using light irradiation, a hot air source or an electrical heater.

However, heating a medium during or after reception of a water-based latex ink is not without problems. For instance, certain types of media may develop thermal marks when being exposed to excessive thermal flux. Moreover, the medium may exhibit significant thermal expansion, which is especially undesirable during printing because it can deteriorate the image quality.

Hence, there exists a need for a printing device that overcomes at least some of these problems.

BRIEF DESCRIPTION OF THE DRAWINGS

Embodiments of the invention are described in more detail and by way of non-limiting examples with reference to the accompanying drawings, wherein.

DETAILED DESCRIPTION

Figure 1:
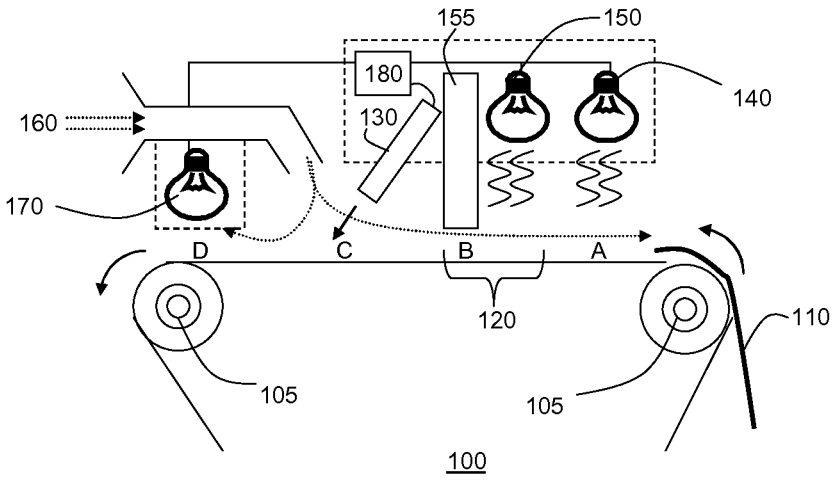
FIG. 1 schematically depicts a printing device according to an embodiment of the present invention.

It should be understood that the Figures are merely schematic and are not drawn to scale. It should also be understood that the same reference numerals are used throughout the Figures to indicate the same or similar parts.

FIG. 1 depicts a printing device 100 according to an embodiment of the present invention. The device 100 is arranged to feed a printing medium 110 over a print platen 120 in a direction indicated by the arrows over the pick-up rollers 105. The rollers 105 are shown by way of non-limiting example only. The printing device 100 may have any suitable means for transporting the printing medium 110 over the print platen 120. The printing medium 110 may be any medium suitable for receiving a latex ink.

The printing device 100 comprises a printing stage 155. This may be any printing stage suitable for printing a latex ink on the printing medium 110. For instance, the printing stage 155 comprises an ink jet printing head coupled to a reservoir for containing the latex ink. Many different types of ink jet printing heads are known to the skilled person, and such printing heads are therefore not described in further detail for reasons of brevity only.

The printing device 100 further comprises a first heating stage 140 for pre-heating the printing medium 110 before it enters the print platen 120, i.e. the region under the printing stage 155, and a second heating stage 150 for heating the printing medium 110 in the region of the print platen 120, i.e. at the printing stage 155 under control of a controller 180. The first heating stage 140 and the second heating stage 150 may be separate stages or a single stage arranged to cover more than one region of the printing device 100. In case of the first heating stage 140 and the second heating stage 150 being separate regions, the controller 180 may be arranged to individually control the first heating stage 140 and the second heating stage 150. In an embodiment, the printing device comprises a controller arrangement comprising separate controllers 180, each arranged to control a separate heating stage of the printing device 100. The separate controllers may be implemented as separate control stages of a single controller.

In an alternative embodiment of the printing device 100, the first heating stage 140 is omitted.

The second heating stage 150 is arranged to ensure that the printing medium 110 is sufficiently warmed up to receive the latex ink from the printing stage 155. The printing medium 110 must be warmed up to ensure that the fluids in the ink, e.g. water, are evaporated from the ink rapidly enough to prevent unwanted spreading of the ink on the printing medium 110. In an embodiment, the printing medium 110 is heated to a temperature of around 55° C. by the second heating stage 150. This temperature is sufficiently high to ensure effective evaporation of said fluids, and low enough to avoid thermal marking of the printing medium 110. However, it will be appreciated that the exact temperature or temperature range is dependent of the type of media, e.g. a higher temperature may be used for media types that are more resistant to thermal marking. In an embodiment, the printing device comprises a user interface for specifying the media type, with the control arrangement comprising a look-up table with respective suitable heating stage output levels for a specified media type, such that the appropriate heat output level may be selected by a user.

Thermal marking may also occur when the printing medium 110 is exposed to a large thermal flux, i.e. a rapid change in temperature. In an embodiment, the printing device 100 is arranged to avoid the occurrence of such a large thermal flux. To this end, the first heating stage 140 is arranged to pre-heat the printing medium 110 in region A of the printing device to e.g. 40° C. Consequently, when the printing medium 110 reaches region B, i.e. the print platen 120, the printing medium 110 only requires a relatively small additional heating step implemented by the second heating stage 150 in order to reach a temperature at which the printing medium 110 can receive the latex ink from the printing stage 155.

The printing device 100 further comprises a third heating stage 170 for curing the latex in the image printed onto the printing medium 110. The third heating stage is also controlled by the controller arrangement 180. In an embodiment, the controller arrangement 180, which will be described in more detail later, is arranged to operate the third heating stage 170 separately from the first heating stage 140 and/or the second heating stage 150. The third heating element 170 is arranged to heat the printing medium 110 in region D of the printing device 100 to a temperature that is sufficient for curing the latex in the latex ink such that a protective latex layer is formed over the image on the printing medium 110. In an embodiment, the third heating element 170 is arranged to heat the printing medium to a temperature around 95° C. Again, it should be understood that different temperatures may be selected for different media types.

In an embodiment, the printing device 100 further comprises a cooling stage 160 for cooling the printing medium 110 in a region C of the printing device 100. The cooling stage 160 may be a fan-assisted air stream generator, which may be responsive to the controller 180. The cooling stage 160 ensures that the thermal expansion of the printing medium 110 is well-controlled over the whole print zone of the printing device 100, and assists in drying the latex ink deposited by the printing stage 155. Moreover, the airflow aids the evaporation of ink solvents, e.g. water. To this end, at least a part of the airflow is arranged to flow parallel to the media towards the print zone in order to remove the water and avoid the ink spreading (bleed and coalescence). In an embodiment, a part of the airflow is also directed towards the curing zone to aid with the removal of solvents from the ink in this stage. Alternatively, a separate cooling stage may be used for this purpose.

The respective heating stages of the printing device 100 may be realized in any suitable way, e.g. by hot air fans or radiation devices. In an embodiment, the respective heating stages are realized by one or more infrared (IR) lamps per heating stage.

In an embodiment, the printing device 100 further comprises one or more temperature sensors 130 for monitoring the temperature of the printing medium 110 in the various regions of the print zone of the printing device 100, such as the region C between the printing stage 155 and the curing zone D. The one or more temperature sensors 130 may be arranged to provide a measurement signal to the controller arrangement 180, which may be arranged to adjust the temperature settings of the respective heating stages and/or the cooling stage in response to these measurement signals. In an embodiment, each heating stage controller is responsive to its own temperature sensor. The one or more temperature sensors 130 may be any suitable temperature sensor.

The controller 180 is arranged to ensure that the print medium 110 exhibits a well-controlled temperature profile over the print zone defined by regions A-D of the printing device 100. Such a well-controlled temperature profile is important to avoid the occurrence of image artifacts caused by thermal marking and/or excessive thermal expansion of the printing medium 110. An example of such a temperature profile is given in FIG. 2.

Figure 2:
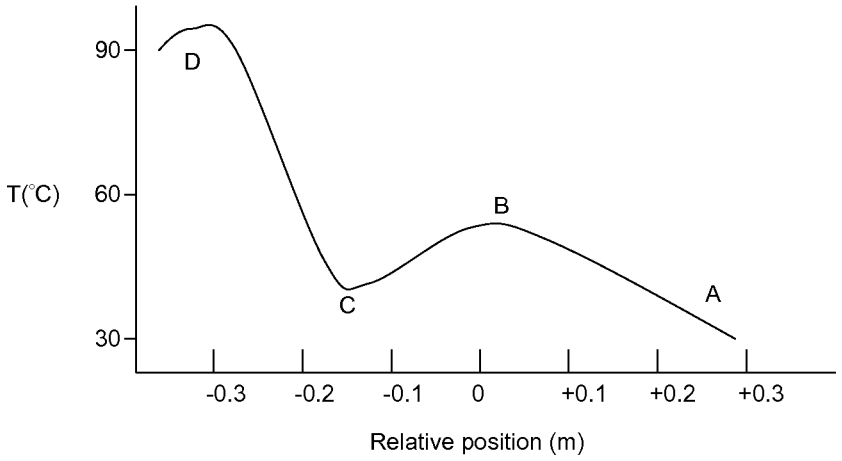
FIG. 2 schematically depicts a temperature profile for a medium fed through the printing device of FIG. 1.

The plot in FIG. 2 depicts the temperature of the printing medium 110 in ° C. as a function of the relative lateral distance of the printing medium 110 from the printing stage 155. Upon entry of the print zone, the printing medium 110 is heated to around 40° C. in region A by the first heating stage 140, after which the printing medium 110 is further heated to around 55° C. in region B by the second heating stage 150. Next, the printing medium 110 is cooled down to around 40° C. in region C, e.g. by the fan-assisted cooling stage 160. It is important to ensure that the temperature of the printing medium 110 upon entry and exit of the printing zone B shows at little variation as possible to avoid print quality artifacts in the image printed on the printing medium 110, which may be caused by differential thermal expansion of the medium 110 in the printing zone B. Subsequently, the printing medium 110 is heated to around 95° C. in curing region D by the third heating stage 170.

The printing device 100 may be arranged to feed the printing media 110 over the print zone in a continuous fashion, or may alternatively be arranged to feed the printing media 110 over the print zone in a stepwise fashion, wherein the printing media 110 is for instance temporarily stopped for receiving the latex ink from the printing stage 155 or for curing the latex ink by the third heating stage 170. The printing media 110 may further comprise unprinted regions, which exhibit a different tolerance to exposure to an elevated temperature than the regions of the printing medium 110 carrying a latex ink.

In an embodiment, the controller arrangement 180 is arranged to control the heating stages of the printing device 100 such that a distinction is made between heating the printing medium 110 during printing and curing an image on the printing medium 110 and heating the printing medium 110 when the printing device 100 is not generating an image onto the printing medium. In the printing/curing mode, the printing device 100 ensures that the printing medium 110 is fed continuously through the printing device, which ensures that the exposure of the printing medium 110 to each of the heating stages does not exceed a certain amount of time, and, as a consequence, a certain amount of thermal exposure.

However, when a printing/curing job is completed, the printing medium 110 may remain stationary in the printing device 100, in which case prolonged exposure to one of the heating stages may cause thermal marking to the printing medium 110. The controller arrangement 180, e.g. the individual controllers of the respective heating stages are therefore arranged to reduce the heat output of the heating stage as soon as the job of that stage is finished, e.g. upon completion of a printing job in the printing zone and upon completion of a curing job in the curing zone. The respective heating stages are not completely switched off to avoid excessive start-up times of the respective heating stages upon commencing a new job. Moreover, a rapid change in temperature of the printing medium 110 could cause rapid thermal expansion of the printing medium, thereby increasing the risk of thermal damage to the printing medium 110.

Figure 3:
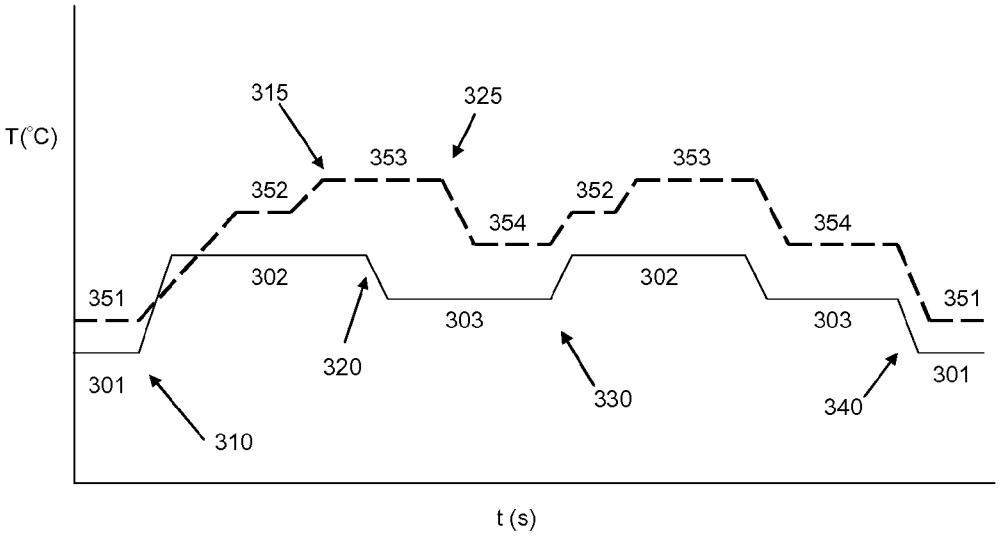
FIG. 3 schematically depicts the stepped temperature profiles of the printing and curing heating stages according to an embodiment of the present invention.

FIG. 3 depicts the respective heating states of the second heating stage 150 (solid line) and the third heating stage 170 (dashed line) in ° C. as a function of time. In this embodiment, the first heating stage 140 and the second heating stage 150 are controlled by separate controllers 180

Table I gives an overview of the various heating states of the second heating stage 150 and the third heating stage 170 shown in FIG. 3.

TABLE I

| Stage 150 state | | Stage 170 state | |
|---|---|---|---|
| 301 | OFF | 351 | OFF |
| 302 | PRINTING | 352 | READY-TO-CURE |
| 303 | STAND-BY | 353 | CURING |
| | | 354 | STAND-BY |

Upon transition 310, which is typically triggered by the initiation a print instruction received by the printing device 100 from an external source, the second heating stage 150 switches from its OFF state to its PRINTING state, causing the second heating stage 150 to heat the printing medium 110 to a temperature suitable for printing the latex ink onto the printing medium 110, e.g. 55° C., and the third heating stage 170 switches to its READY-TO-CURE state, in which the third heating stage 170 produces a heat output that does not damage the printing medium 110 during prolonged exposure to the heating stage 170. The temperature of the printing medium 110 in the curing region D in this READY-TO-CURE state typically is an intermediate temperature that is lower than the temperature of the printing medium 110 during curing but higher than the temperature of the printing medium 110 in the OFF state of the third heating stage 170.

The READY-TO-CURE state further ensures that the third heating stage 170 can be quickly switched to its CURING state while avoiding a large thermal flux, thus reducing the risk of thermal damage to the printing medium 110.

Upon the latex ink carrying printing medium 110 reaching the curing zone D, as indicated by the transition 315, the controller 180 switches the third heating stage 170 from the READY-TO-CURE state to the CURING state, in which the printing medium 110 is heated to a temperature at which the latex in the ink is cured to form a protective layer over the printed image, e.g. 95° C.

Simultaneously, upon completion of printing the image on the printing medium 110, the controller 180 switches the second heating stage 150 from its PRINTING state to a STANDBY state, as indicated by transition 320. In the STANDBY state, the second heating stage 150 is arranged to heat the printing medium 110 to an intermediate temperature that is that is lower than the temperature of the printing medium 110 during printing but higher than the temperature of the printing medium 110 in the OFF state of the second heating stage 150 in order to protect non-printed media from the formation of thermal artifacts thereon.

In an embodiment, the controller 180 of the curing heating stage 170 is configured to engage the CURING STATE a predefined amount of time after engaging the PRINTING state. The predefined amount of time is based on the distance between the printing stage 155 and the third heating stage 170 and the propagation speed of the printing medium 110 over the printing zone of the printing device 100.

The third heating stage 170 may also be switched to a STANDBY state upon completion of the curing of the printed image on the printing medium 110, as indicated by the transition 325. The STANDBY states ensure that the printing medium 110 is not exposed to excessive temperatures whilst being stationary in the printing device 100, this avoiding the formation of thermal artifacts on non-printed regions of the printing medium 110, and is not exposed to an excessive thermal flux during initiation of the printing of a next image, as indicated by transition 330. Upon power-down of the printing device 100, the second heating stage 150 and the third heating stage 170 return to their OFF states, as shown by transition 340.

In an embodiment, the respective controller stages 180 each may comprise a state machine to implement the control mechanism shown in FIG. 3. Since the implementation of a state machine in hardware or software may be realized in many ways that all require routine skill for the skilled practitioner, a detailed description of the implementation details of such state machines is omitted for reasons of brevity only.

Figure 4:
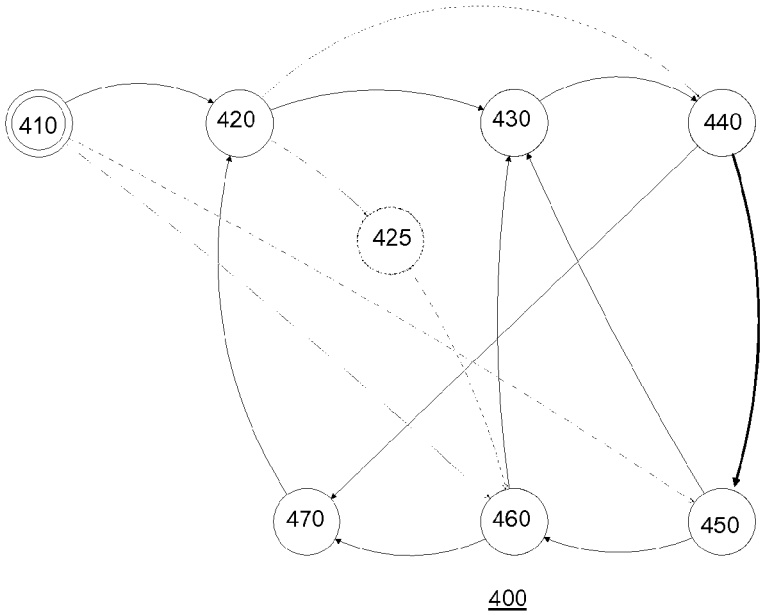
FIG. 4 schematically depicts a printing zone state machine according to an embodiment of the present invention.

FIG. 4 depicts an embodiment of a state machine 400 for controlling the second heating stage 150. Table II gives an overview of the states in this state machine.

TABLE II

| State Number | State Name |
|---|---|
| 410 | Init |
| 420 | Off |
| 425 | Warming up for Standby |
| 430 | Warming up for Printing |
| 440 | Printing |
| 450 | Cooling down to Standby |
| 460 | Standby |
| 470 | Cooling down to Off |

The state machine 400 starts in initial state 410, after which the state machine 400 proceeds to state 420 in case the temperature of the printing medium 110 is lower than a printing medium threshold temperature defined for state 410, which corresponds with state 301 in FIG. 3. From state Off, the state machine 400 may proceed to state 425 in case activation of the printing device 100 does not coincide with a print request, or to state 430 in case the activation of the printing device 100 does coincide with a print request. State 430 corresponds with the transition from state 301 to state 302 in FIG. 3.

Once the second printing stage 150 has warmed up, the state machine progresses to state 440, which corresponds with state 302 in FIG. 3. The transition from state 430 to state 440 may occur after a predefined period of time or after receiving a signal from a temperature sensor indicating that the required temperature has been reached. From state 440, the state machine 400 may proceed to state 450, which corresponds with the transition from state 302 to 303 in FIG. 3, upon completion of printing the image on the printing medium 110 or to state 470 upon the printing device 100 being switched off.

From state 450, the state machine 400 may proceed to state 460, which corresponds to state 303 in FIG. 3 upon completion of the cooling down cycle. This transition may occur after a predefined period of time or after receiving a signal from a temperature sensor indicating that the required temperature has been reached. Alternatively, the state machine 400 may step from state 450 to state 430 in case of the reception of a new printing instruction by the printing device 100.

From standby state 460, the state machine 400 may revert back to state 430 in case of the reception of a new printing instruction by the printing device 100. The state machine 400 may also proceed to state 470 corresponding to the transition from state 303 to 301 in FIG. 3. The transition to state 470 may be invoked by the printing device 100 being switched to an idle mode, e.g. powered-down mode.

In case the temperature of the printing medium 110 exceeds the threshold temperature defined for state 410 but does not exceed its threshold temperature defined for standby state 460, the state machine 400 may step from state 410 to 460. The threshold temperature for the standby state is chosen such that an unprinted printing medium 110 is not at risk of experiencing thermal damage when being exposed to the standby temperature.

In case the temperature of the printing medium 110 exceeds the threshold temperature defined for state 410 as well as exceeds its threshold temperature defined for standby state 460, the printing medium 110 is at risk of experiencing thermal damage. Consequently, the state machine 400 is arranged to step from state 410 to 450 in order to cool down the printing medium 110, which may trigger the cooling stage 160 to be activated.

In an embodiment, the controller 180 may be overruled by a manual instruction, causing the state machine 400 to step from state 420 directly to state 440.

Figure 5:
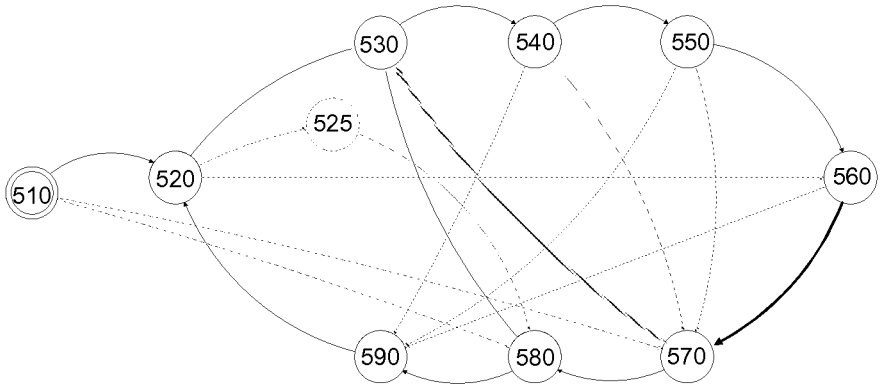
FIG. 5 schematically depicts a curing zone state machine according to an embodiment of the present invention.

FIG. 5 depicts an embodiment of a state machine 500 for controlling the third heating stage 150. Table II gives an overview of the states in this state machine.

TABLE III

| State Number | State Name |
|---|---|
| 510 | Init |
| 520 | Off |
| 525 | Warming up for Standby |
| 530 | Warming up for Ready to cure |
| 540 | Ready to cure |
| 550 | Warming up for curing |
| 560 | Curing |
| 570 | Cooling down to Standby |
| 580 | Standby |
| 590 | Cooling down to Off |

The state machine 500 starts in initial state 510, after which the state machine 500 proceeds to state 520 in case the temperature of the printing medium 110 is lower than a printing medium threshold temperature defined for state 510, which corresponds with state 351 in FIG. 3. From state Off, the state machine 500 may proceed to state 525 in case activation of the printing device 100 does not coincide with a print request, which means that no curing is (immediately) required, or to state 530 in case the activation of the printing device 100 does coincide with a print request, and the third heating stage 170 is to be brought into a ready-to-cure state. State 430 corresponds with the transition from state 351 to state 352 in FIG. 3.

Once the third printing stage 170 has reached its ready-to-cure temperature, the state machine 500 progresses to state 540, which corresponds with state 352 in FIG. 3. The transition from state 530 to state 540 may occur after a predefined period of time or after receiving a signal from a temperature sensor indicating that the required temperature has been reached.

From state 540, the state machine 500 may proceed to state 550, which corresponds with the transition from state 352 to 353 in FIG. 3, upon an indication that a printed printing medium 110 is approaching the third heating stage 170. Upon reaching the curing temperature, the state machine 500 progresses to state 560, in which the latex in the printed medium is cured. Upon reaching the end of the printed region of the printing medium 110, e.g. the end of the document, the state machine 500 progresses to state 570, in which the third heating stage 170 is cooled down such that the unprinted printing medium 110 is not exposed to a temperature that may cause thermal damage to the unprinted printing medium 110. State 570 corresponds with the transition from state 353 to 354 in FIG. 3.

When the third heating stage 170 is sufficiently cooled down, the state machine 500 progresses to state 580, which corresponds with state 354 in FIG. 3. From this standby state, the state machine 500 may proceed to state 590 in case the printing device is switched off, or may revert to state 530 in case of a new curing task.

Other transitions in the state machine 500 are also feasible. For instance, the state machine 500 may progress from any of states 540, 550 and 560 to state 590 in case the printing device 100 is switched off whilst the state machine 500 resides in any of the states 540, 550 and 560. Similarly, the state machine 500 may progress from states 540 and 550 to state 570 in case the printing device 100 is switched to a standby mode whilst the state machine 500 resides in any of the states 540 and 550. This may for instance occur when a print request is cancelled.

In case the temperature of the printing medium 110 exceeds the threshold temperature defined for state 510 but does not exceed its threshold temperature defined for standby state 580, the state machine 500 may step from initial state 510 to 580. The threshold temperature for the standby state 580 is chosen such that an unprinted printing medium 110 is not at risk of experiencing thermal damage when being exposed to the standby temperature.

In case the temperature of the printing medium 110 exceeds the threshold temperature defined for off state 510 as well as exceeds its threshold temperature defined for standby state 580, the printing medium 110 is at risk of experiencing thermal damage. Consequently, the state machine 500 is arranged to step from state 510 to 570 in order to cool down the printing medium 110, which may trigger the cooling stage 160 to be activated.

In an embodiment, the controller(s) 180 may be overruled by a manual instruction, causing the state machine 500 to step from state 510 directly to state 560.

The state machines 400 and 500 implement different aspects of the temperature control method of the present invention. It will be appreciated that FIGS. 4 and 5 depict simplified versions of the state machines 400 and 500. For instance, exceptions have not been shown for reasons of clarity only. Such exceptions may for instance occur if a state has a time-out limit, with the state machine progressing to an error state or another predefined state upon exceeding the time-out limit of the state in which the state machine resides.

It will further be appreciated that although the state machines 400 and 500 are shown as independent state machines, certain states and transitions in these state machines are interrelated. For instance, as shown in FIG. 3, the transition 310 (exiting the OFF state) occurs at the same time for both the second heating stage 150 and the third heating stage 170, which means that the state machines for these heating stages enter respective states 420 and 520 at the same time. Similarly, the state machine 500 will enter curing state 560 a predefined amount of time after the state machine 400 entering the printing state 450 corresponding with the predefined amount of time it takes the printing medium 110 to propagate from region B to region D in the printing device 100.

By entering the heating stages 150 and 170 (and 140 if separately controlled) into a pre-heating state such as standby states 460 and 580 respectively, the heating stages can be quickly brought to the required temperature for printing and curing. This facilitates the use of relatively cheap heating elements such as IR lamps, which have a long lifetime and require less power to operate than alternative heating elements such as fast shutter-based designs.

The one or more controllers 180 may be implemented in software on a processor such as a central processing unit of the printing device 100. The controller software may be made available on any suitable computer-readable data carrier.

Figure 6:
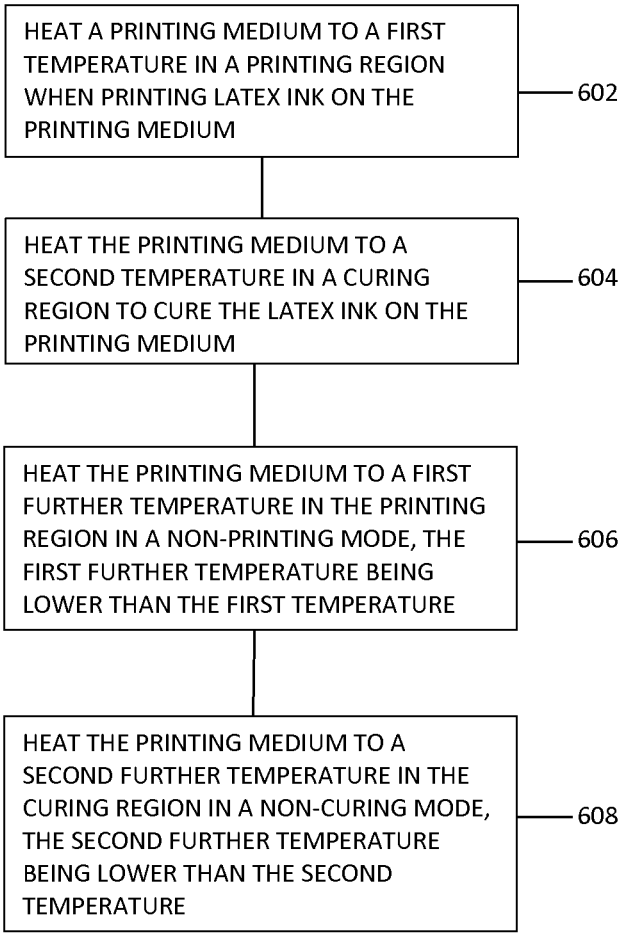
FIG. 6 is a flow diagram of a process of printing latex ink.

FIG. 6 is a flow diagram of a process of printing latex ink on a printing medium. The printing medium is heated (at 602) to a first temperature in a printing region when printing latex ink on the printing medium. The printing medium is heated (at 604) to a second temperature in a curing region to cure the latex ink on the printing medium. The printing medium is heated (at 606) to a first further temperature in the printing region in a non-printing mode, where the first further temperature is lower than the first temperature. The printing medium is heated (at 608) to a second further temperature in the curing region in a non-curing mode, where the second further temperature is lower than the second temperature.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

We claim:

1. The method comprising:

controlling, by the controller, a first heating stage to heat the printing medium to a first temperature in a printing region when printing latex ink on the printing medium;

controlling, by the controller, a preheating stage upstream of the first heating stage to heat the printing medium to a second temperature prior to the printing, the second temperature less than the first temperature;

controlling, by the controller, a curing heating stage to heat the printing medium to a curing temperature greater than the first temperature in a curing region to cure the latex ink on the printing medium; and controlling, by the controller, a cooling stage located between the first heating stage and the curing heating stage to cool the printing medium to the second temperature after the printing medium has been heated by the first heating stage and prior to heating of the printing medium by the curing heating stage.

2. The method of claim 1, wherein the cooling stage includes an air stream generator to generate an airflow to cool the printing medium.

3. The method of claim 2, further comprising directing, by the cooling stage, a portion of the airflow to a zone of the second heating stage to remove solvent from the latex ink in the zone of the second heating stage.

4. The method of claim 1, wherein the cooling stage is a fan-assisted cooling stage.

5. The method of claim 1, wherein controlling the curing heating stage comprises controlling the curing heating stage to heat the printing medium from the second temperature to the curing temperature.

6. The method of claim 1, further comprising:

receiving, by the controller, a temperature of the printing medium sensed by at least one temperature sensor, where controlling at least one of the first heating stage, second heating stage, and cooling stage is in response to the received temperature.

7. The method of claim 1, further comprising:

accessing, by the controller, information relating to target temperature levels of the first heating stage for different types of the printing media; and receiving, by the controller, an input identifying a type of the printing medium, wherein controlling the first heating stage comprises controlling the first heating stage to heat the first heating stage to the target temperature level, selected form the target temperature levels, for the identified type of the printing medium.

8. A non-transitory computer readable storage medium storing computer code that upon execution cause a controller to:

control a preheating stage to heat a printing medium to a first target temperature;

control a first heating stage downstream of the preheating stage to heat the printing medium to a second target temperature in a printing region when printing latex ink on the printing medium, the second target temperature greater than the first target temperature;

control a second heating stage to heat the printing medium to a second temperature greater than the second target temperature in a curing region to cure the latex ink on the printing medium; and control a cooling stage located between the first and second heating stages to cool the printing medium to the first target temperature after the printing medium has been heated by the first heating stage and prior to heating of the printing medium by the second heating stage.

9. A printing device for printing a latex ink on a printing medium, comprising:

a first heating stage to heat the printing medium at least during printing the latex ink on the printing medium;

a preheating stage upstream of the first heating stage to heat the printing medium prior to the printing;

a second heating stage to cure the latex ink on the printing medium;

a cooling stage located between the first and second heating stages to cool the printing medium after the printing medium has been heated by the first heating stage and prior to heating of the printing medium by the second heating stage, wherein the cooling stage includes an air stream generator to generate an airflow to cool the printing medium, wherein the cooling stage is to direct a portion of the airflow to a zone of the second heating stage; and a controller to:

control the first heating stage to heat the printing medium to a first target temperature during the printing, control the preheating stage to heat the printing medium to a second target temperature lower than the first target temperature, and control the second heating stage to heat the printing medium to a curing temperature higher than the first target temperature to cure the latex ink on the printing medium, and control the cooling stage to cool the printing medium to the second target temperature after the first heating stage has heated the printing medium to the first target temperature and prior to the second heating stage heating the printing medium to the curing temperature.

10. The printing device of claim 9, wherein at least a part of the airflow flows in parallel to the printing medium to evaporate a solvent from the latex ink.

11. The printing device of claim 9, wherein the directing of the portion of the airflow to the zone of the second heating stage is to cause evaporation of a solvent from the latex ink in the zone of the second heating stage.

12. The method of claim 2, wherein at least a part of the airflow flows in parallel to the printing medium to evaporate a solvent from the latex ink.

13. The printing device of claim 9, wherein the cooling stage is a fan-assisted cooling stage.

14. The printing device of claim 9, further comprising at least one temperature sensor for sensing a temperature of the printing medium, the controller being responsive to a measured temperature from the at least one temperature sensor.

15. The printing device of claim 9, wherein the first heating stage comprises a plurality of heating elements including a first heating element to heat the printing medium prior to the printing, and a second heating element to heat the printing medium during the printing.

16. The printing device of claim 9, wherein the controller is to further access information relating to target temperature levels of the first heating stage for different types of the printing media.

17. The printing device of claim 16, wherein the controller is to further:

receive an input identifying a type of the printing medium, wherein the controller is to control the first heating stage to the target temperature level, selected from the target temperature levels, for the identified type of the printing medium.

* * * * *